US008087520B2

(12) United States Patent
Milella, Jr. et al.

(10) Patent No.: US 8,087,520 B2
(45) Date of Patent: Jan. 3, 2012

(54) LOCKING AUTOMOBILE MAT HANGER AND DISPLAY DEVICE

(76) Inventors: Michael Joseph Milella, Jr., Schaumburg, IL (US); David Allen Reband, Antioch, IL (US); Karl Joseph Mazur, Richmond, IL (US); Michael William Negus, Milton, WI (US); Robert A. Price, Glencoe, IL (US)

( * ) Notice: Subject to any disclaimer, the term of this patent is extended or adjusted under 35 U.S.C. 154(b) by 283 days.

(21) Appl. No.: 12/589,720

(22) Filed: Oct. 27, 2009

(65) Prior Publication Data

US 2011/0095155 A1 Apr. 28, 2011

(51) Int. Cl.
*A47F 7/16* (2006.01)

(52) U.S. Cl. ..... 211/45; 223/91

(58) Field of Classification Search ..... 248/220.21, 248/220.22, 222.11; 223/85, 91, 95; 211/45, 211/113

See application file for complete search history.

(56) References Cited

U.S. PATENT DOCUMENTS 3,841,478 A * 10/1974 Wells et al. ..... 206/495
D235,316 S * 6/1975 Wells ..... D9/457
4,011,946 A 3/1977 Savage et al.
4,155,531 A 5/1979 Bagne
4,382,986 A 5/1983 Reuben
5,097,996 A * 3/1992 Chen ..... 223/91
5,152,404 A 10/1992 Salrin et al.
5,257,694 A 11/1993 Wallach
D514,493 S 2/2006 MacNeil
D522,428 S 6/2006 MacNeil
D529,852 S 10/2006 Thom
D530,250 S 10/2006 Thom
7,150,381 B2 * 12/2006 Goldman ..... 223/91
7,188,755 B2 * 3/2007 Wu ..... 223/91
2006/0226178 A1 * 10/2006 Wu ..... 223/85

* cited by examiner

*Primary Examiner* — Amy Sterling
*Assistant Examiner* — Erin W Smith
(74) *Attorney, Agent, or Firm* — Husch Blackwell LLP

(57) ABSTRACT

A locking automobile mat hanger and display device consists of two hanger housings that cooperate with an interchangeable adapter insert to secure a plurality of automobile floor mats. The device includes housings having a retaining portion and an adapter insert, whereby the adapter insert and the retaining portion of the housing create channels in which automobile floor mats may be inserted and retained. The device also has a cutout section in the housings whereby a user may easily grasp and carry the entire mat hanger assembly. The device further contains a hook section disposed on the housings, which allows for the entire mat hanger assembly to be hung from retail displays, and also allows for efficient storage. The label application section of the hanger aids inventory organization.

17 Claims, 5 Drawing Sheets

LOCKING AUTOMOBILE MAT HANGER AND DISPLAY DEVICE

TECHNICAL FIELD

The various embodiments of the present invention relate to devices for holding, securing, transporting, and displaying automobile floor mats.

BACKGROUND OF THE INVENTION

Automobile floor mats are used to protect the floor of the automobile from undue wear and damage. Another benefit of typical automobile floor mats is that they provide added safety and reduce the dangers associated with slipping. These features are often accomplished by constructing automobile floor mats from injection-molded plastic. This process allows for manufacturing floor mats with textured non-slip surfaces as well as various other shapes, contours and textures. Additionally, automobile floor mats are often constructed with a ridge extending vertically along perimeter of mat. This ridge acts to retain liquid and dirt when placed on the floor of an automobile, and aids in cleanup and maintenance. A further advantage of automobile floor mats is that they can be removed for cleaning, and they can be replaced when worn or damaged.

Automobile floor mats are often sold in retail stores, and therefore there is a need for packaging and displaying the floor mats to potential customers. An important feature of such packaging and display devices is that they can secure multiple floor mats together, while also providing an efficient means for displaying the mats to a customer.

One previous device for displaying automobile floor mats used hangers made from cardboard arranged to overlay the top of the automobile floor mat, whereby the floor mat is affixed to the cardboard by means of staples. An additional section of the cardboard overlay is formed into a hook that can be hung on a display rack.

U.S. Pat. No. 4,155,531 to Bagne discloses a display device for car rugs and mats that is made of a single cardboard support piece which has an extension on one end which is folded over to form a flap. The cardboard support piece and car mat are wrapped in plastic which is heat-shrunk, thereby securing the merchandise to the cardboard. A hole or slit is formed in the plastic over the hole in the fold of the cardboard support piece. The plastic hook is inserted in this hole or slit, allowing the entire package to be hung from a display rack.

U.S. Pat. No. 4,856,654 to Reuben discloses a system for displaying two-mat sets. The packaging system includes a hanger for suspending the floor mat package from a display bar. A single pouch is attached alongside the floor mats for holding certain accompanying fastening components. Staples penetrate the mats, the pouch, and the hanger. The staples serve to hold the mats, pouch and hanger together.

U.S. Pat. No. 5,257,694 to Wallach discloses a display package for displaying four-piece automotive floor mat sets. The display package comprises a first envelope and a first pair of floor mats disposed in a layered disposition within the first envelope. A second envelope, or pocket, is piggy-backed on the first envelope and a second pair of floor mats is disposed in a layered disposition within the second envelope. The display package is characterized by clamping means having opposing clamping surfaces for bracketing the first pair of mats and exerting generally opposing forces perpendicular to the outside surfaces of the first pair of floor mats. The opposing forces increase the friction between the first pair of floor mats and also between the clamping surfaces and the first pair of floor mats' outside surfaces. The increased friction secures the first pair of floor mats in relation to each other and in relation to the clamping means without penetrating the first pair of floor mats.

Previous automobile mat hanging and display devices suffer from several deficiencies. Prior devices are often made of cardboard and therefore lack sufficient strength and durability. Additionally, the prior devices often must be stapled to the automobile mat itself, thus damaging the mat. The staples must be forcibly extracted by the purchaser using tools such as pliers, or a screwdriver. In addition, this system is unable to handle four-piece floor mat sets since staples will not penetrate a stack of four mats. Additionally, prior mat hanging devices may not hold more or less than a specific number of mats. In other words, previous holders are designed for only one application (two mats or four mats, for example), and cannot be adapted for other uses. Prior mat hanging devices are also deficient in that they may only be used once. Paper or cardboard display devices cannot be reused for other mats.

Current heavy-duty automobile floor mats can be large and due to their flexibility, hard to lift, transport, and hang by hand. This difficulty increases where there are multiple mats to be transported or hung at once. Therefore, there is a continuing need for an inexpensive means for gripping and holding multiple floor mats during transport and display in a retail store.

CONCISE DESCRIPTION OF THE DRAWINGS

SUMMARY OF THE INVENTION

Embodiments of the present invention meet the needs described above in a locking automobile mat hanger and display device. Generally described, the present invention includes two hanger housings that cooperate with an interchangeable adapter insert to secure a plurality of automobile floor mats. Specifically, the mat hanger includes housings having a retaining portion and an adapter insert, whereby the adapter insert and the retaining portion of the housing create channels in which automobile floor mats may be inserted and retained. Another aspect of the invention relates to a cutout section whereby a user may easily grasp and carry the entire mat hanger assembly. A further aspect of the invention relates to a hook section of the housings, which allows for the entire mat hanger assembly to be hung from retail displays.

Automobile floor mats are designed to accommodate various sizes and shapes of automobile floors and other cargo areas. As a result, certain heavy-duty floor mats can be large and therefore difficult to lift, transport, and hang by hand. These mats are also often made of flexible thermoplastic. While this flexibility is advantageous when providing custom fits to specific automobile models, it is difficult to handle a large, flexible floor mat by hand. This difficulty increases where there are multiple mats to be transported or hung at once. To solve the problem of handling and transporting large, flexible floor mats, the current invention incorporates a removable adapter insert along with cooperating grasping portions of the hanger housings. The hanger is able to engage and secure the raised ridge that runs along the perimeter of automobile floor mats, thus providing a means for securing together a plurality of automobile floor mats, and also providing a means for grasping the floor mats for transport and display.

DETAILED DESCRIPTION

Figure 1:
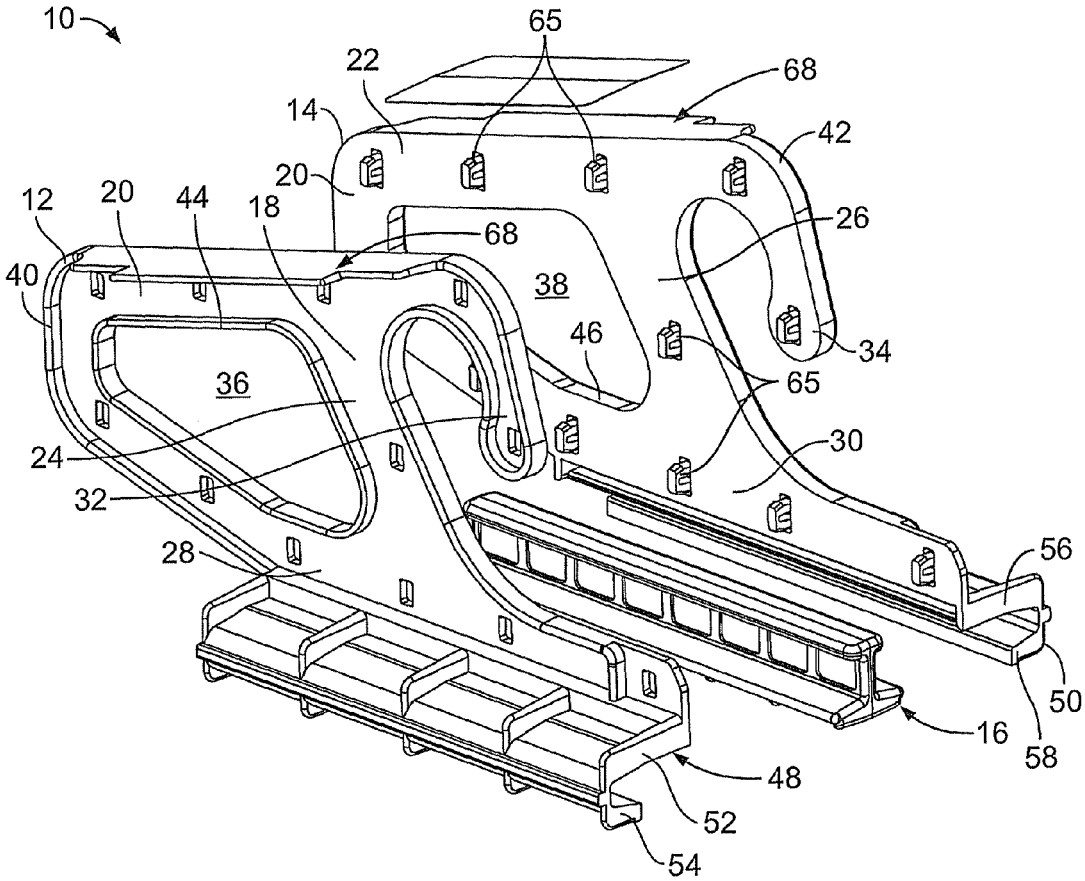
FIG. 1 depicts an angle view of the prospective arrangement of the hanger.

In accordance with one embodiment of the present invention, there is provided a locking mat hanger and display device. Referring now to FIG. 1, a hanger 10 for hanging and displaying automobile floor mats is shown. The hanger 10 consists of two hanger housings 12 and 14 that connectively couple with each other to engage an adapter insert 16, thereby securing a plurality of automobile floor mats therebetween, as will be explained in further detail below. The hanger 10, including adapter insert 16, is formed by plastic-based injection molding techniques that are well known in the art. The first housing 12 has an engaging side (not shown) and an outer side 18. The second housing 14 has an engaging side 20 and an outer side (not shown). The housings 12 and 14 also consist of top portions 20, 22, bracing portions 24, 26, base portions 28, 30, and hook portions 32, 34, respectively. The top portion 20, bracing portion 24, and base portion 28 of housing 12 generally define a cutout section 36. Housing 14 contains a similar cutout section 38 defined by top portion 22, bracing portion 26, and base portion 30.

Housings 12 and 14 have a raised outer ridge 40 and 42, respectively, along a portion of the perimeter of the housing, as well as a raised inner ridge 44 and 46, respectively, along the perimeter of the cutout sections. The raised ridges 40, 42, 44 and 46 improve rigidity and provide strength to the hanger 10 when hanger housings 12 and 14 are connectively coupled together. To provide further strength and rigidity, the housings are constructed from a material such as thermoplastic elastomer. A further advantage of the raised ridge is to provide added comfort when a user grasps the hanger 10 through the cutout sections 36 and 38 to handle the mats, as will be explained in more detail below.

The housings 12 and 14 have cutout sections 36 and 38 for allowing a user to grasp the hanger through the cutout sections. A further advantage of cutout sections 36 and 38 is that they aid the user when hanging the mat hanger assembly on a display rack. Instead of holding the hanger by the hook portion 34, 34, which can lead to getting fingers caught between the hanger and display hanger rod, a the user can grasp the mat hanger assembly through the cutout section. The raised inner ridges 44 and 46 surrounding cutout sections 36 and 38, respectively, cooperate to provide a uniform surface that does not exert undue pressure on the user's hand while grasping the mat hanger 10.

Housing 12 has a molded, rigid retaining portion 48 extending generally perpendicularly from the base portion 28 for engagement with floor mats. Housing 14 has a corresponding molded, rigid retaining portion 50 extending generally perpendicularly from the base portion 30 for engagement with floor mats. As can be seen more clearly in FIGS. 2-5, the retaining portions 48 and 50 extend outward from housing. Retaining portion 48 has an upper portion 52 and a lower portion 54, and retaining portion 50 has an upper portion 56 and a lower portion 58. The upper and lower portions 52, 54 and 56, 58 of the retaining portions 48 and 50 create a generally U-shaped channel into which the extending ridge of an automobile floor mat can be inserted, as will be explained in more detail below.

Figure 3:
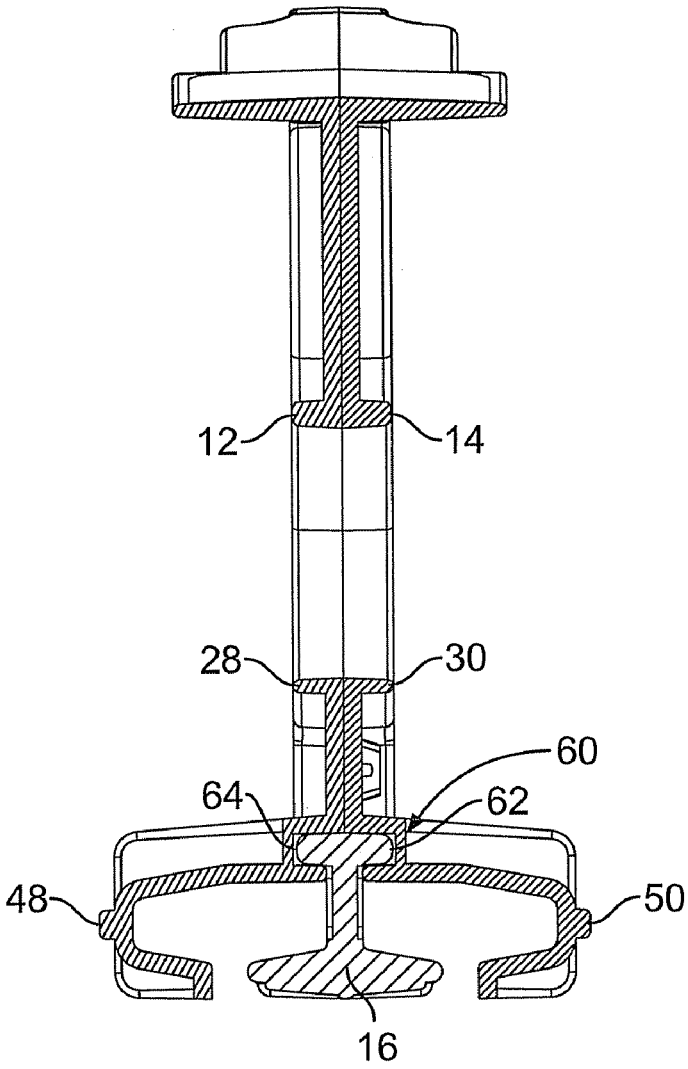
FIG. 3 depicts a cross-sectional view showing a four-mat insert of the prospective arrangement of the hanger.

Referring now to FIG. 3, in one embodiment of the current invention, housings 12 and 14 have an adapter insert reception area 60 for accepting adapter insert 16. The adapter insert reception area 60 is formed by the cooperation of molded channels 62 and 64 running along the base of the housing 12 and 14, respectively, proximal to the junction of the base portions 28 and 30 and the retaining portions 48 and 50, respectively.

In an alternative embodiment of the current invention, the adapter insert reception area is replaced by corresponding slots running along the junction of the base portion 28 and 30 and the retaining portions 48 and 50 of housings 12 and 14. These slots allow for engaging the retaining tabs of adapter insert 16 (described in more detail below).

Referring back to FIG. 1, the first and second housings 12 and 14 are affixed together with a plurality of securing snaps 66. The snaps 66 consist of a plurality of hollow tabs on the engaging side 20 of second housing 14 that engage a corresponding set of retaining tabs on the outer side 18 of first housing 12. The second hanger housing 14 contains a plurality of hollow tabs spaced regularly about the housing 14, extending perpendicularly away from the engaging side 20 of the second housing. In an alternate embodiment, the housings can be affixed together with female receivers and male snaps, or a combination of a plurality of heat stakes and a corresponding plurality of alignment posts as would be familiar to one of skill in the art. An additional feature of a possible embodiment uses a plurality of guide pins and corresponding guide holes to help align hanger housings correctly.

Referring now to FIG. 1, label surface 68 is shown. Label surface 68 is created by two generally planar tabs extending perpendicularly away from the top portion 20 and 22 of the hanger housings 12 and 14, respectively. The tabs cooperate to form a relatively flat surface 68 on which labels or other identifying indicators may be affixed.

Figure 2:
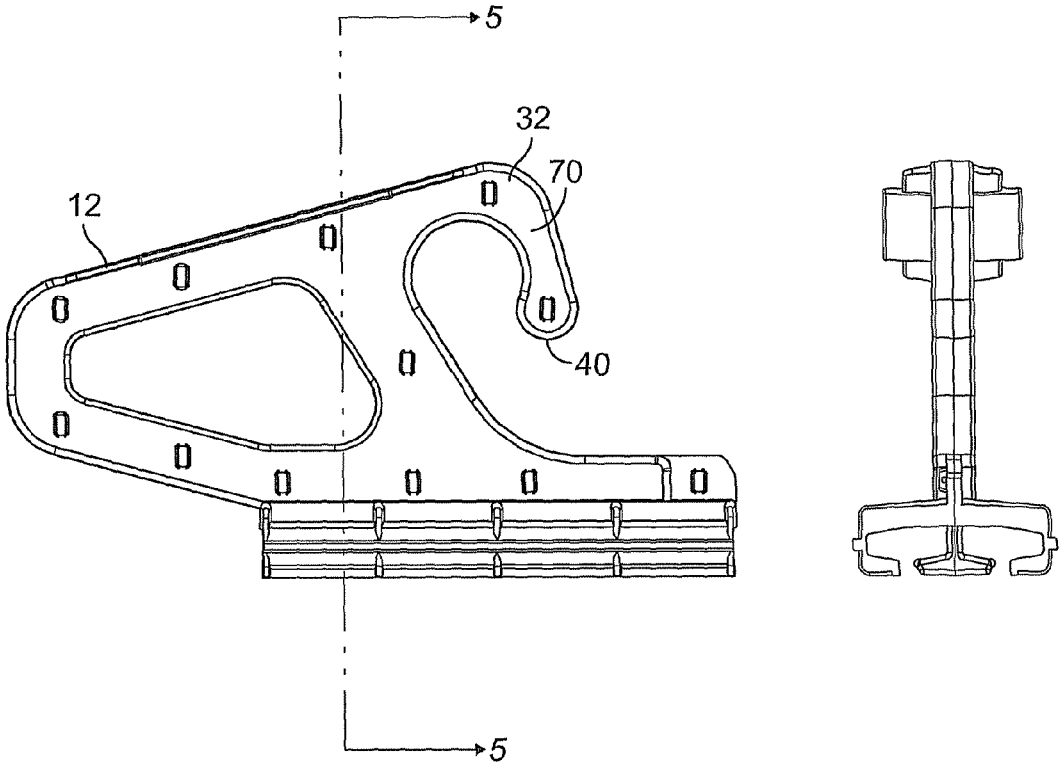
FIG. 2 depicts a side view with a cross section view of the prospective arrangement of the hanger.

Referring now to FIG. 2, hook structure 70 is shown. Hook structure 70 is formed by hook portions 32 and 34 when housings 12 and 14 are connectively coupled with snaps 66. The inner diameter of the hook structure is generally circular in shape. The hook structure 70 is formed such that it has the ability to easily fit over a cylindrical hanging rod for display. Hook structure 70 has the ability to be hung from hanging rods of various shapes and diameters. The hook structure 70 derives its rigidity from the raised outer ridge 40 and 42 along a portion of the perimeter of the housings 12 and 14, as well as the rigidity of the plastic material used in its manufacture.

Figure 5:
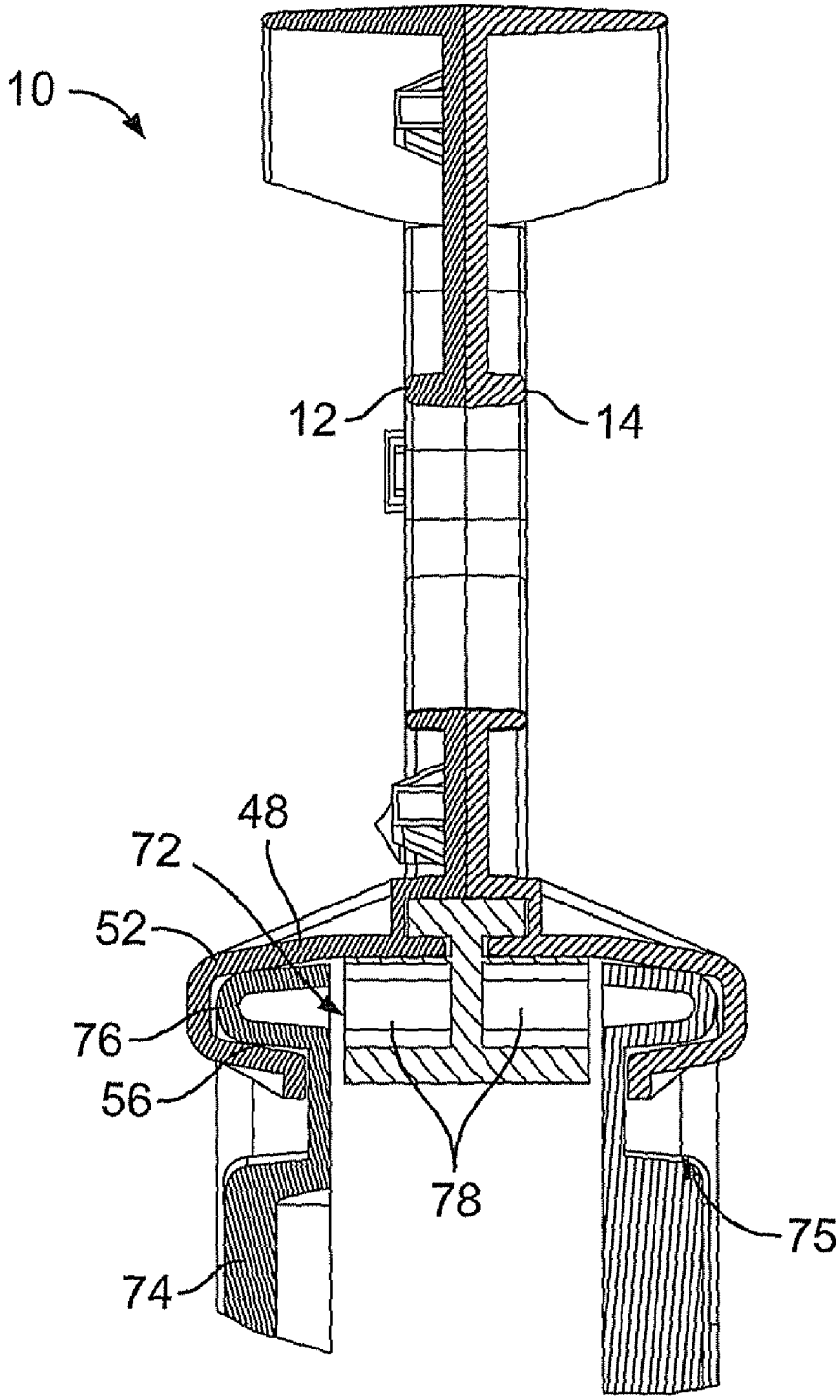
FIG. 5 depicts a cross-sectional view showing a two-mat insert with mats affixed.

Referring now to FIG. 5, the 2-mat adapter insert 72 is shown. The adapter insert 72 engages with the first and second housings 12 and 14 as explained above. Adapter insert 72 has support ribs 78 built in to create a tight fit of floor mat raised ridge within the channel. In one embodiment of the current invention, automobile floor mat 74 with raised ridge 76 fits securely within the generally U-shaped channel formed by the upper portion 52 and lower portion 56 of retaining portion 48. A corresponding geometry retains second floor mat 75 within the hanger 10. The support ribs 78 of adapter insert 72 ensure that the automobile floor mat is secured within the generally U-shaped channel formed by the upper and lower portions 52, 54 and 56, 58 of the retaining portions 48 and 50. These ribs act as a wedge to help prevent the mat ridge from deforming and slipping out of the retaining portion of the housings 12 and 14.

Figure 4:
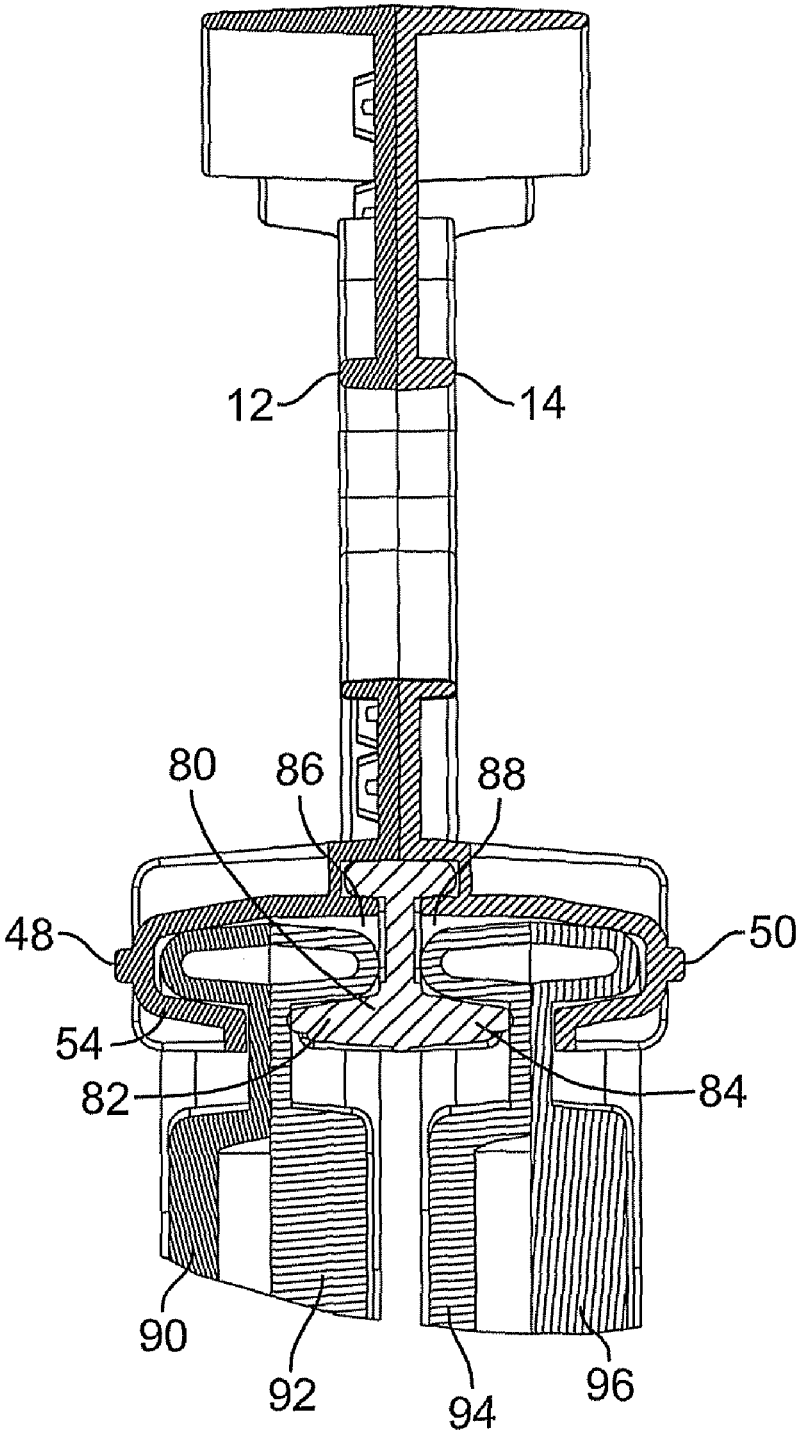
FIG. 4 depicts a cross-sectional view showing a four-mat insert with mats affixed.

Referring now to FIG. 4, the 4-mat adapter insert 80 is shown. The adapter insert 80 engages with the first and second housings 12 and 14 as explained above. Adapter insert 80 employs retaining tabs 82 and 84 that extend perpendicularly from the adapter insert 80, and extend generally the length of the housings 12 and 14. When engaged with the retaining portions 48 and 50 of the housings 12 and 14, the 4-mat adapter insert 80 creates dual retaining channels 86 and 88 that can accommodate two sets of two mats 90, 92, 94, and 96, when the pairs are arranged back-to-back. The gap between the retaining tab 82 and the lower portion 54 of retaining portion 48 is narrow, such that the geometry of the raised ridges of the automobile floor mats create a secure fit that will not allow the floor mats to disengage from the retaining portion.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments and equivalents falling within the scope of the appended claims.

Various features of the invention are set forth in the following claims.

What is claimed is:

1. An automobile floor mat hanger comprising;

a first housing, wherein the first housing consists of a first top portion connectively coupled at its distal end to a distal end of a first base portion, a first bracing portion connectively coupled to and extending between the proximal end of the first top portion and the proximal end of the first base portion, a first rigid retaining portion extending generally perpendicularly from the first base portion, and a first hook portion extending from the junction of the first top portion and the first bracing portion, wherein the first housing has an engaging side and an outer side;

a second housing, wherein the second housing consists of a second top portion connectively coupled at its distal end to a distal end of a second base portion, a second bracing portion connectively coupled to and extending between the proximal end of the second top portion and the proximal end of the second base portion, a second rigid retaining portion extending generally perpendicularly from the second base portion, and a second hook portion extending from the junction of the second top portion and the second bracing portion, wherein the second housing has an engaging side and an outer side;

an adapter insert, wherein the adapter insert consists of a vertical member having a length corresponding generally to the length of the first and second retaining portions, first and second engagement tabs extending perpendicularly from the top end of and along the length of the vertical member, and first and second retaining tabs extending perpendicularly from the bottom end of and along the length of the vertical member; and wherein the engaging sides of the first and second housings couple with each other and also with the first and second engagement tabs of the adapter insert, and further wherein the adapter insert and the first and second retaining portions of the first and second housings cooperate to create a plurality of retaining channels.

2. The hanger of claim 1, wherein a label surface consists of a first generally planar tab extending perpendicularly away from the first top portion of the first housing, and a second generally planar tab extending perpendicularly away from the second top portion of the second housing, wherein the first and second tabs cooperate to form a relatively flat label surface on which labels or other identifying indicators may be affixed.

3. The hanger of claim 1 wherein the first and second housings and the adapter insert are manufactured by thermoplastic-based injection molding techniques.

4. The hanger of claim 1 wherein the first and second top portions, the first and second bracing portions, and the first and second base portions of the first and second housings define a generally triangular cutout section.

5. The hanger of claim 1 wherein the first retaining portion has a first upper portion and a first lower portion, wherein the first upper and lower portions are arranged to create a generally U-shaped channel.

6. The hanger of claim 1 wherein the second retaining portion has a second upper portion and a second lower portion, wherein the second upper and lower portions are arranged to create a generally U-shaped channel.

7. The hanger of claim 4 wherein the first and second housings have a first and a second raised outer ridge, respectively, along a portion of the perimeter of the housing, and a first and second raised inner ridge, respectively, along the perimeter of the first and second cutout sections.

8. The hanger of claim 1, wherein the first and second housings have a first and a second molded channel, respectively, at the base of the first and second housing, respectively, proximal to the junction of the first and second base portions and the first and second retaining portions, respectively, wherein the first and second molded channels cooperate to form an adapter insert reception area for retaining the adapter insert.

9. The hanger of claim 1, wherein the first and second housings have a first slot and a second slot, respectively, at the base of the first and second housing, respectively, proximal to the junction of the first and second base portions and the first and second retaining portions, respectively, wherein the first and second slots cooperate to form an adapter insert reception slot for retaining the adapter insert.

10. The hanger of claim 1, wherein the first and second housings are connectively coupled with a plurality of securing devices extending from the engaging side of the first and second housings.

11. The hanger of claim 10, wherein the plurality of securing devices are snaps.

12. The hanger of claim 10, wherein the plurality of securing devices is a plurality of heat stakes and a corresponding plurality of alignment posts.

13. The hanger of claim 1, wherein the hook portion has an inner diameter that is generally circular.

14. The hanger of claim 1, wherein the adapter insert has a plurality of support ribs extending perpendicularly from the vertical member and spaced regularly along the length of the vertical member between the engagement tabs and the retaining tabs, wherein when the adapter insert with support ribs is engaged with the first and the second housings, the size of the retaining channels is limited by the size of the support ribs.

15. The hanger of claim 10, wherein the plurality of retaining channels securely engage a plurality of floor mats having raised outer ridges.

16. The hanger of claim 15, wherein the plurality of securing devices extending from the engaging side of the first and second housings may be disengaged and re-engaged multiple times to allow the hanger to be re-used with subsequent pluralities of mats.

17. The hanger of claim 15, wherein the plurality of mats may be removed from the retaining channels by a user with manual force.

* * * * *